US005822818A

United States Patent [19]

Chao et al.

[11] Patent Number: 5,822,818

[45] Date of Patent: Oct. 20, 1998

[54] SOLVENT RESUPPLY METHOD FOR USE WITH A CARBON DIOXIDE CLEANING SYSTEM

[75] Inventors: Sidney C. Chao, Manhattan Beach; Edna M. Purer, Los Angeles, both of Calif.

[73] Assignee: Hughes Electronics, El Segundo, Calif.

[21] Appl. No.: 837,961

[22] Filed: Apr. 15, 1997

[51] Int. Cl.[6] ..... D06F 43/08

[52] U.S. Cl. ..... 8/158; 68/13 R; 68/18 R; 68/18 C; 134/10; 134/107; 134/108

[58] Field of Search ..... 8/142, 158, 159; 68/18 R, 18 C, 13 R; 134/10, 12, 107, 108

[56] References Cited

U.S. PATENT DOCUMENTS

| | | | |
|---|---|---|---|
| 4,012,194 | 3/1977 | Maffei | 8/142 |
| 5,013,366 | 5/1991 | Jackson et al. | 134/10 X |
| 5,068,040 | 11/1991 | Jackson | 134/1 X |
| 5,267,455 | 12/1993 | Dewees et al. | 68/18 R X |
| 5,316,591 | 5/1994 | Chao et al. | 134/10 X |
| 5,339,844 | 8/1994 | Stanford, Jr. et al. | 134/107 |
| 5,456,759 | 10/1995 | Stanford, Jr. et al. | 134/10 X |
| 5,467,492 | 11/1995 | Chao et al. | 8/159 |

*Primary Examiner*—Philip R. Coe
*Attorney, Agent, or Firm*—Leonard A. Alkov; William C. Schubert; Glenn H. Lenzen, Jr.

[57] ABSTRACT

A method of replenishing liquid carbon dioxide solvent in a liquid carbon dioxide dry cleaning system or other dense phase carbon dioxide cleaning system. The method uses dry-ice or solid carbon dioxide, as a replenishing stock, thus reducing transportation, storage and handling costs. The method disposes solid carbon dioxide blocks in a cleaning chamber after a cleaning cycle. Liquid carbon dioxide solvent is boiled and is used to melt the solid carbon dioxide blocks. Liquid carbon dioxide solvent produced by melting the solid carbon dioxide blocks is pumped from the cleaning chamber into a storage tank to replenish the liquid carbon dioxide solvent.

12 Claims, 2 Drawing Sheets

SOLVENT RESUPPLY METHOD FOR USE WITH A CARBON DIOXIDE CLEANING SYSTEM

BACKGROUND

The present invention relates generally to a solvent replenishing method for use in cleaning systems, and more particularly, to a solvent replenishing method for use in cleaning systems that use dense-phase carbon dioxide as a solvent.

All conventional organic solvents used for degreasing or cleaning either present health and safety risks or are environmentally detrimental. For example, 1,1,1-trichloroethane depletes the ozone layer, perchloroethylene is a suspected carcinogen, while petroleum based solvents are flammable and produce smog.

Carbon dioxide is an inexpensive and unlimited natural resource, that is non-toxic, non-flammable, it does not produce smog, or deplete the ozone layer. In its dense phase form (both liquid and supercritical), it exhibits solvating properties typical of hydrocarbon solvents. Carbon dioxide is a good solvent for fats and oils, it does not damage fabrics or dissolve common dies. As such carbon dioxide is an environmentally friendly solvent that can be efficiently used either for common part/substrate degreasing, or for fabric and garment cleaning.

A number of patents disclosing cleaning equipment or processes that use dense phase carbon dioxide (liquid and supercritical) as a cleaning solvent have been issued, both for part cleaning and/or degreasing, or for garment dry-cleaning. Some of these patents are as follows. U.S. Pat. No. 4,012,194, U.S. Pat. No. 5,267,455, and U.S. Pat. No. 5,467,492. All of these patents disclose the use of liquid carbon dioxide as a cleaning medium for fabrics and garments. U.S. Pat. No. 5,339,844, U.S. Pat. No. 5,316,591, and U.S. Pat. No. 5,456,759 address part cleaning and/or degreasing using liquid carbon dioxide as a cleaning medium. U.S. Pat. No. 5,013,366 and U.S. Pat. No. 5,068,040 disclose a cleaning process through phase shifting with dense phase carbon dioxide, and cleaning and sterilizing with supercritical carbon dioxide.

An example of a typical liquid carbon dioxide garment dry cleaning system is disclosed in U.S. Pat. No. 5,467,492, issued Nov. 21, 1995, that is assigned to the assignee of the present invention. This liquid carbon dioxide dry cleaning system comprises a walled cleaning vessel with a perforated cleaning basket within, containing the load to be cleaned, a reservoir that supplies the liquid carbon dioxide to the cleaning vessel, apparatus for agitating the liquid within the walled cleaning vessel, which agitates the garment load within the perforated basket. Means of temperature and pressure control are provided in order to maintain preset temperature and pressure process parameters, along with means of soil separation from the fluid and solvent recovery after a cleaning cycle.

However, none of the prior art patents mentioned above address issues related to the cost of replenishing the carbon dioxide solvent. This is a major element of the operating cost of dense phase carbon dioxide cleaning systems, because transportation, storage and handling of compressed gases is very expensive.

Accordingly, it is an objective of the present invention to provide for an improved method of replenishing the liquid carbon dioxide solvent in these dense phase carbon dioxide cleaning systems.

SUMMARY OF THE INVENTION

To meet the above and other objectives, the present invention provides for a method of replenishing liquid carbon dioxide solvent in a dense phase carbon dioxide cleaning system. The method may be used with a dense phase carbon dioxide cleaning system comprised of a cleaning chamber, a storage tank containing liquid carbon dioxide solvent, a pump (or other means) for introducing the cleaning solvent into the cleaning chamber, a separator or still, means for removing dissolved or dispersed soils from the cleaning fluid, a refrigerator/condenser and a heater in the still that provides for temperature and pressure control, and an optional gas recovery condenser for gaseous carbon dioxide recovery.

The method uses solid carbon dioxide blocks (dry-ice) that are disposed in the cleaning chamber after a cleaning cycle. The cleaning chamber is closed, such as by closing a door, and the cleaning chamber is vented to atmosphere for a predetermined period of time. As the solid carbon dioxide sublimes, the resulting gaseous carbon dioxide expels the air from the cleaning chamber. The cleaning chamber is then opened to the still (that is connected to the storage tank on the liquid side through a make-up line). The heater in the still is turned on and boils off gaseous carbon dioxide. The warm gaseous carbon dioxide melts the solid carbon dioxide blocks (dry-ice) and the temperature of the resulting liquid carbon dioxide is slowly raised to a set point. At this time the heater in the still is turned off, the main pump is activated, and the liquid carbon dioxide is pumped from the cleaning chamber back into the storage tank. The gaseous carbon dioxide left in the chamber may also be recovered back into the storage tank using the gas compressor.

The method may be used to replenish the lost carbon dioxide solvent in systems that use dense phase carbon dioxide cleaning processes using dry-ice. The make-up dry-ice may also contain optional additives such as surfactants, static dissipating compounds or deodorants where appropriate (such as in garment dry-cleaning). The present resupply method is economically advantageous, because the solvent transport and resupply in its liquid form requires costly high pressure steel enclosures and cumbersome delivery systems.

The method reduces the costs of operating dense phase carbon dioxide cleaning systems and processes in general, and specifically reduces the cost of liquid carbon dioxide garment dry-cleaning processes as described in U.S. Pat. No. 5,467,492. The savings result from a reduction in carbon dioxide solvent storage costs, solvent transportation costs and solvent handling costs when using the present method.

BRIEF DESCRIPTION OF THE DRAWINGS

The various features and advantages of the present invention may be more readily understood with reference to the following detailed description taken in conjunction with the accompanying drawings, wherein like reference numerals represent like structural elements, and in which.

DETAILED DESCRIPTION

Figure 1:
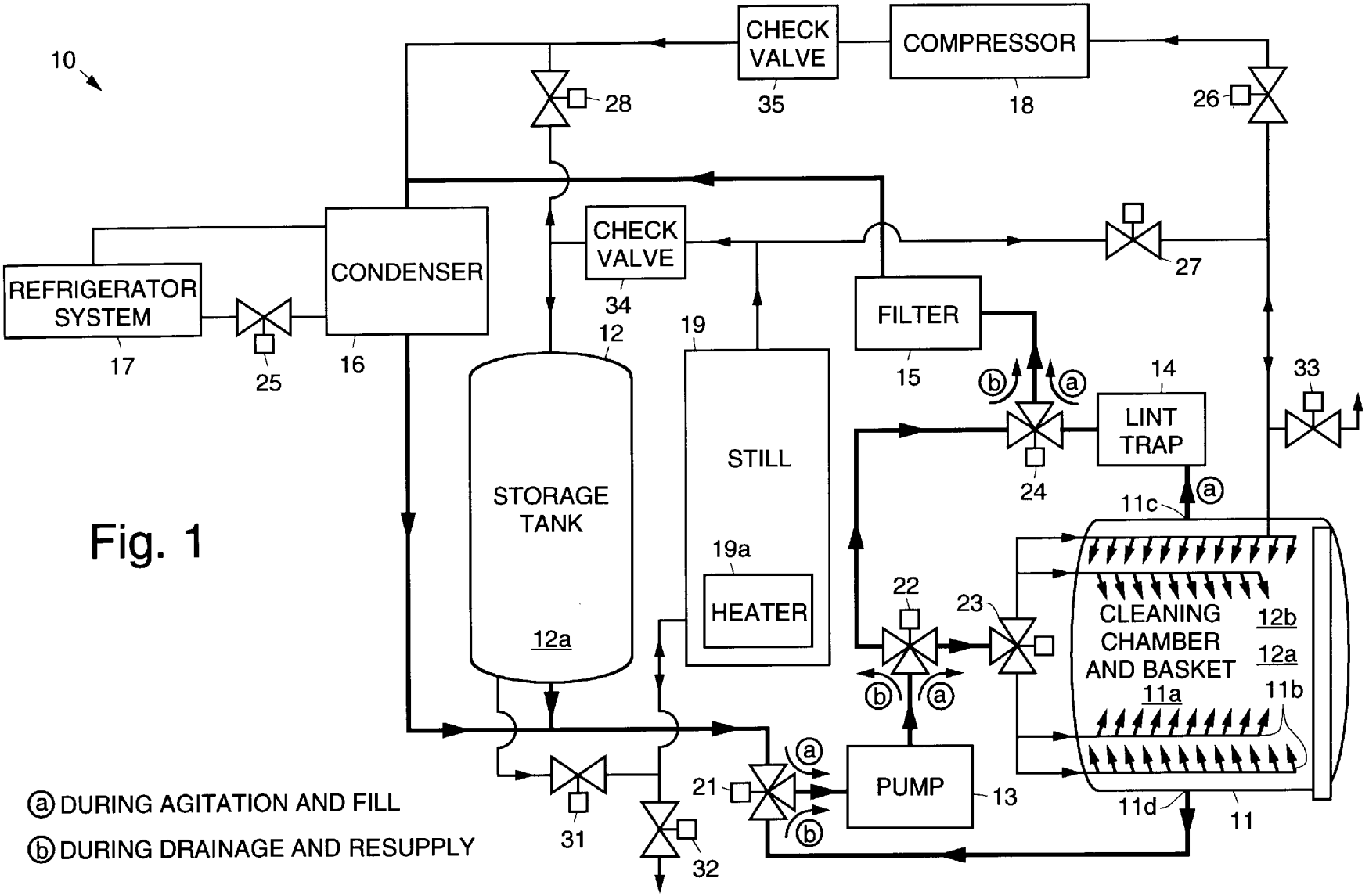
FIG. 1 illustrates a liquid carbon dioxide dry cleaning system whose liquid carbon dioxide solvent may be replenished using methods in accordance with the principles of the present invention.

Referring to the drawing figures, FIG. 1 illustrates an exemplary closed loop liquid carbon dioxide cleaning system 10 whose liquid carbon dioxide solvent may be replenished using methods 40 (FIG. 2) in accordance with the principles of the present invention. FIG. 1 represents one embodiment of a carbon dioxide cleaning system 10 that may utilize the present invention and is presented only to illustrate the solvent resupply method provided by this invention. The present invention is therefore not limited to use only with the specific system 10 shown in FIG. 1.

The exemplary liquid carbon dioxide dry-cleaning system 10 has a cleaning chamber 11 or pressurizable vessel 11 with a door or lid (not shown) that houses a perforated basket that holds a load of garments 11*a* that are to be cleaned. A storage tank 12 that holds liquid carbon dioxide solvent 12*a* is coupled by a three-way pump inlet valve 21 to a pump 13 that supplies the cleaning chamber 11 with liquid carbon dioxide solvent 12*a*. An output of the pump 13 is coupled by way of a three-way valve 22 to a cleaning chamber inlet valve 23 that is attached to nozzle manifolds 11*b* in the 10 cleaning chamber 11.

A first output 11*c* of the cleaning chamber 11 is coupled by way of a lint trap 14 to a first input of lint trap valve 24. A second output 11*d* of the cleaning chamber 11 is coupled to a second input of the pump inlet valve 21. The output of the lint trap valve 24 is coupled to a filter 15 that filters the liquid carbon dioxide solvent 12*a*. The output of the filter 15 is coupled through a condenser 16 to the input of the pump valve 21. An output of the storage tank 12 is also coupled to the input of the pump valve 21. A refrigerator system 17 is coupled to the condenser 16 and has a condenser valve 25 for controlling the amount of refrigerant coupled to the condenser 16.

The cleaning chamber 11 is coupled by way of a compressor valve 26 to a gas recovery compressor 18 that is used to compress gaseous carbon dioxide solvent 12*b* into its liquid state and couple the compressed gaseous carbon dioxide 12*a* through a check valve 35 to the condenser 16 and back to the storage tank 12. A gas head valve 27 is used to couple off gaseous carbon dioxide 12*b* from the cleaning chamber 11 to the still 19. The gaseous carbon dioxide 12*b* coupled through the gas head valve 27 is also coupled by way of a condenser valve 28 to the condenser 16.

Liquid solvent 12*a* from the storage tank 12 feeds the still 19 through a valve 31. A heater 19*a* in the still 19 is used to raise the temperature of the liquid carbon dioxide which melts solid blocks of carbon dioxide dry-ice disposed in the cleaning chamber 11 used in the present method 40, as will be described below and with reference to FIG. 2. A second drain valve 32 is coupled to the still 19 and is used to drain soil left after distillation. A vent valve 33 is coupled to the output of the cleaning chamber 11 and is used to vent the cleaning chamber 11 to the atmosphere, as will be discussed below.

During liquid circulation and cleaning cycles, the three-way valves 21, 22, 24 are in position "a" shown in FIG. 1, while during liquid drain cycles, the three-way valves 21, 22, 24 are in position "b". In a typical cleaning cycle, the load of garments 11*a* is placed into the perforated basket in the cleaning chamber 11, and its door or lid is closed. The liquid carbon dioxide solvent 12*a* from the storage tank 12 is pumped into the cleaning chamber 11 using the pump 13. At this time a recirculating loop is established (illustrated by the bold lines in FIG. 1, with the valves 21, 22, 24 set to configuration "a") by appropriately closing and opening selected valves. The load of garments 11*a* is agitated, while the liquid carbon dioxide 12*a* is recirculated by the pump 13 through the cleaning chamber 11, the lint trap 14, the filter train 15, and back to the cleaning chamber 11. At the end of the agitation cycle, the liquid phase of the carbon dioxide solvent 12*a* is recovered back into the storage tank 12 using the pump 13, with the valves 21, 22, 24 set to configuration "b".

At this point in the cleaning cycle, the cleaning chamber 11 contains the load of garments 11*a* and gaseous carbon dioxide solvent 12*b* at about 700 psi. The cleaning chamber 11 is decompressed to atmospheric pressure when the gas compressor 18 recovers the gaseous carbon dioxide solvent 12*b* back into the storage tank 12. At this time, the door of the cleaning chamber 11 is opened and the cleaned load of garments 11*a* is removed from the cleaning chamber 11.

A fraction of the liquid carbon dioxide solvent 12*a* is lost during each cleaning cycle. At a minimum, this fraction is equivalent to the weight of a cleaning-chamberfull of gaseous carbon dioxide 12*b* at atmospheric pressure, plus any gaseous carbon dioxide solvent 12*b* adsorbed by the load of garments 11*a*. Therefore, the storage tank 12 must be replenished on a periodic basis with liquid carbon dioxide solvent 12*a* to make up for the lost gaseous carbon dioxide solvent 12*b*.

Commercially, liquid carbon dioxide solvent 12*a* is handled and transported in pressurized cylinders. Except for bulk low pressure storage containers, these cylinders are not insulated and are not refrigerated. The liquid carbon dioxide solvent 12*a*contained in such cylinders is therefore at ambient temperature and is maintained at a relatively high pressure, typically about 850 psi. Bulk containers for storing liquid carbon dioxide solvent 12*a* at low pressure (typically at or about 200–350 psi) are well insulated and are equipped with a means of refrigeration to control and limit internal temperatures and pressures within the bulk containers.

In both cases, the cost of the liquid carbon dioxide solvent 12*a* to a consumer is a function of the cost of handling and demurrage of the pressurized containers, and the shipping weight of the containers. In addition to this, the method of introducing the replenishing liquid carbon dioxide solvent 12*a* into the storage tank 12 requires an additional external pump (not shown), thus increasing capital costs.

Figure 2:
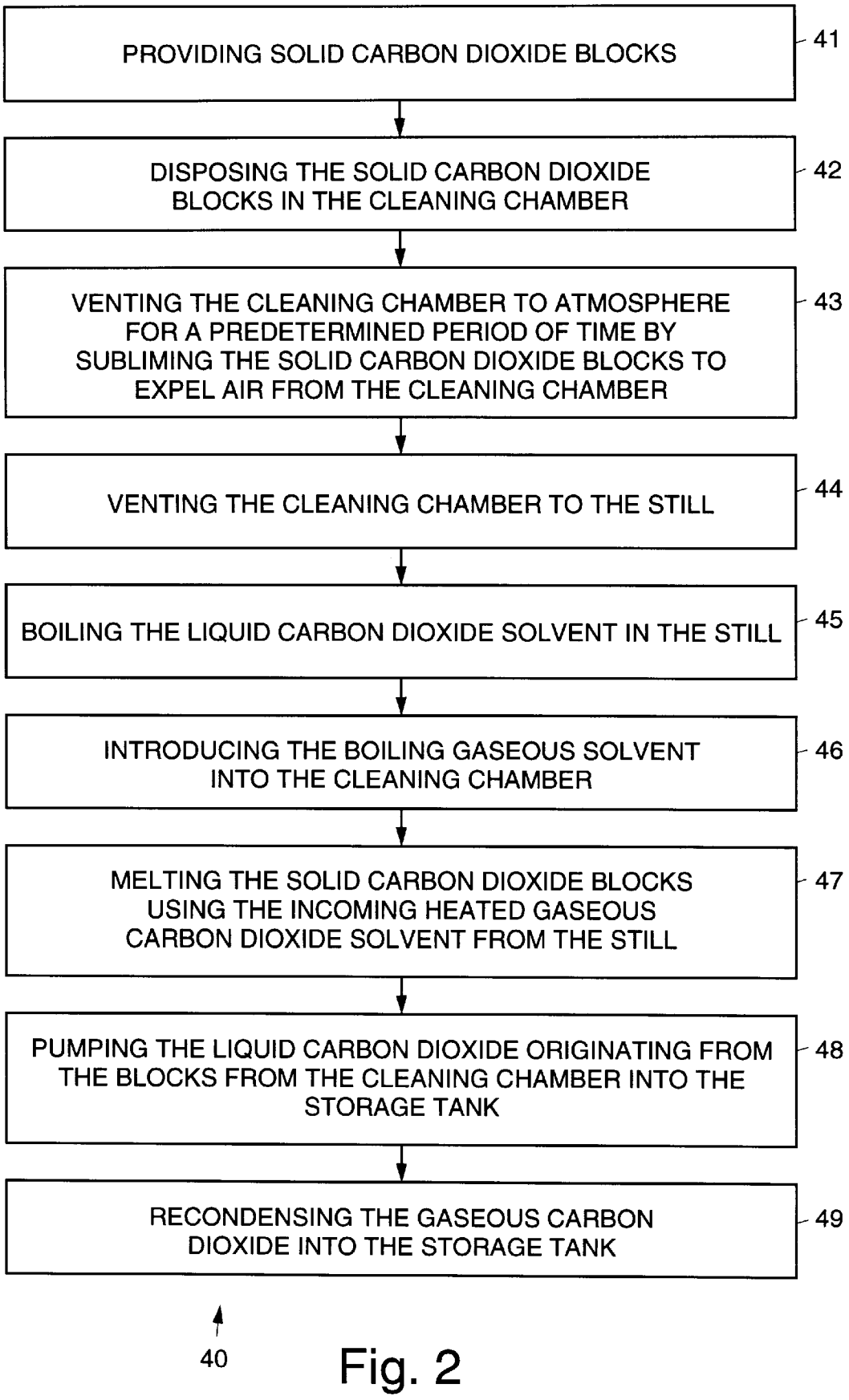
FIG. 2 is a flow diagram illustrating a method of replenishing liquid carbon dioxide solvent in accordance with the principles of the present invention.

Referring now to FIG. 2, it is a flow diagram illustrating one method 40 in accordance with the principles of the present invention of replenishing liquid carbon dioxide solvent 12*a* in the system 10. The present invention provides 41 solid carbon dioxide blocks, or bricks, (which may also contain additives, such as surfactants, a static dissipating compound and/or deodorizer, for example), that are used to resupply or replenish liquid carbon dioxide solvent 12*a* in the storage tank 12. The solid carbon dioxide blocks comprise solid dry-ice that are at a temperature of −109.3 degrees Fahrenheit and that are transported and stored using thermal insulation, without pressure containment, thus reducing overall resupply or replenishing costs and complexity. The solid carbon dioxide blocks of dry-ice may be introduced into the cleaning system 10 in the manner described below and with reference to FIG. 2.

The solid carbon dioxide blocks are placed 42 into the perforated basket in the cleaning chamber 11, typically at the end of a work shift, for example, and the door of the cleaning chamber 11 is closed. The vent valve 33 is opened for a predetermined period of time, and air is expelled 43 from the cleaning chamber 11 by subliming the solid carbon dioxide blocks, because carbon dioxide is heavier than air.

The vent valve 33 is then closed and the gas head valve 27 between the cleaning chamber 11 and the still 19 is opened 44 to the cleaning chamber 11. The heater 19*a* in the still 19 is turned on which boils 45 the liquid carbon dioxide solvent 12*a*. The boiled liquid carbon dioxide is introduced 46 into the cleaning chamber 11, which in turn heats the cleaning chamber 11 and the solid carbon dioxide blocks. The solid carbon dioxide blocks of dry-ice melt 47, and are converted from solid to liquid in the cleaning chamber 11, and the temperature of the resulting liquid carbon dioxide rises until a predetermined temperature (54 degrees Fahrenheit) is reached. At this time, the valves 21, 22, 24 are switched to position "b", the pump 13 is turned on, and the liquid carbon dioxide 12*a* produced by melting the solid carbon dioxide blocks is pumped 48 from the cleaning chamber 11 into the storage tank 12. The heater 19*a* is then turned off. The compressor 18 is turned on, and the gaseous carbon dioxide 12*b* is recondensed 49 into the storage tank 12. The system 10 is now ready for the next cleaning cycle.

The method 40 reduces operating costs of cleaning systems 10 using dense phase carbon dioxide in general, and specifically the cost of operating the liquid carbon dioxide jet cleaning system disclosed in U.S. Pat. No. 5,467,492, for example, by reducing the cost of the solvent resupply and replenishing process.

Thus, a method for replenishing solvent used in a liquid carbon dioxide dry cleaning system has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A method of replenishing solvent used in a liquid carbon dioxide cleaning system having a cleaning chamber, a storage tank containing liquid carbon dioxide solvent, a pump for pumping the liquid solvent from the storage tank to the cleaning chamber, a gas recovery compressor for compressing gaseous solvent into its liquid state, a condenser for recondensing gaseous carbon dioxide, and a still containing a heater for heating the liquid solvent, said method comprising the steps of:

providing solid carbon dioxide blocks;

disposing the solid carbon dioxide blocks in the cleaning chamber;

venting the cleaning chamber to atmosphere for a predetermined period of time to expel air from the cleaning chamber;

venting the cleaning chamber to the still;

boiling the liquid solvent in the still to produce boiling gaseous solvent;

introducing the boiling gaseous solvent into the cleaning chamber;

melting the solid carbon dioxide blocks in the cleaning chamber using the boiling gaseous solvent from the still; and pumping the melted carbon dioxide blocks from the cleaning chamber into the storage tank to replenish the liquid solvent.

2. The method of claim 1 wherein the solid carbon dioxide blocks contain a static dissipating compound.

3. The method of claim 1 wherein the solid carbon dioxide blocks contain a surfactant.

4. The method of claim 1 wherein the solid carbon dioxide blocks contain a deodorant.

5. The method of claim 1 wherein the solid carbon dioxide blocks comprise solid dry-ice.

6. A method of replenishing solvent used in a dense phase carbon dioxide cleaning system having a cleaning chamber, a storage tank containing dense phase carbon dioxide solvent, a pump for pumping the solvent from the storage tank to the cleaning chamber, and a still containing a heater for heating the solvent, said method comprising the steps of:

disposing solid carbon dioxide blocks in the cleaning chamber;

boiling the dense phase solvent in the still to produce boiling gaseous solvent;

melting the solid carbon dioxide blocks using the boiling gaseous solvent from the still; and pumping the melted carbon dioxide blocks from the cleaning chamber into the storage tank to replenish the liquid solvent.

7. The method of claim 6 further comprising the steps of:

prior to the boiling step, venting the cleaning chamber to atmosphere for a predetermined period of time to expel air from the cleaning chamber; and venting the cleaning chamber to the still.

8. The method of claim 6 wherein the solid carbon dioxide blocks contain a static dissipating compound.

9. The method of claim 6 wherein the solid carbon dioxide blocks contain a surfactant.

10. The method of claim 6 wherein the solid carbon dioxide blocks contain a deodorant.

11. The method of claim 6 wherein the solid carbon dioxide blocks comprise solid dry-ice.

12. A method of replenishing solvent in a dense phase carbon dioxide processing system having a chamber, a storage tank containing dense phase carbon dioxide solvent, and a pump for pumping the solvent from the storage tank to the chamber, said method comprising the steps of:

disposing solid carbon dioxide blocks in the chamber;

boiling the dense phase solvent to produce boiling gaseous solvent;

melting the solid carbon dioxide blocks using the boiling gaseous solvent; and pumping the melted carbon dioxide blocks from the chamber to the storage tank to replenish the solvent therein.

* * * * *